US011761146B2

(12) United States Patent
Sibeaud et al.

(10) Patent No.: US 11,761,146 B2
(45) **Date of Patent: *Sep. 19, 2023**

(54) PORTABLE PRESSING APPLIANCE COMPRISING A REMOVABLE ACCESSORY

(71) Applicant: SEB S.A., Ecully (FR)

(72) Inventors: Mathilde Sibeaud, Lyons (FR); Olivier Moine, Aix-les-Bains (FR); Victor Perbet, Vienne (FR)

(73) Assignee: SEB S.A.

( * ) Notice: Subject to any disclaimer, the term of this patent is extended or adjusted under 35 U.S.C. 154(b) by 0 days.

This patent is subject to a terminal disclaimer.

(21) Appl. No.: 17/500,527

(22) Filed: Oct. 13, 2021

(65) Prior Publication Data

US 2022/0120029 A1 Apr. 21, 2022

(30) Foreign Application Priority Data

Oct. 16, 2020 (FR) ..... 2010647

(51) Int. Cl.
*D06F 75/20* (2006.01)
*D06F 75/18* (2006.01)
(Continued)

(52) U.S. Cl.
CPC ..... *D06F 75/20* (2013.01); *D06F 75/18* (2013.01); *D06F 75/24* (2013.01); *D06F 75/34* (2013.01)

(58) Field of Classification Search
CPC ..... D06F 75/00–40
See application file for complete search history.

(56) References Cited

U.S. PATENT DOCUMENTS 5,235,759 A * 8/1993 Rizzuto, Jr. ..... A45D 20/122 34/97
5,546,674 A * 8/1996 Lange ..... A46B 15/0051 34/97
(Continued)

FOREIGN PATENT DOCUMENTS

CN 207498690 U 6/2018
DE 102018222293 A1 6/2020
(Continued)

OTHER PUBLICATIONS

French Search Report for Application No. FR 2010647, dated Jul. 16, 2021, 2 pages.

*Primary Examiner* — Ismael Izaguirre
(74) *Attorney, Agent, or Firm* — Lerner David LLP

(57) ABSTRACT

A pressing appliance including a body having a handle and a steam emission head connected to the handle, the steam emission head having a treatment face configured to press against a garment to be pressed, the treatment face including at least one steam outlet orifice and one heatable surface configured to contact the garment, the appliance further including at least one accessory configured to be removably mounted on the steam emission head, wherein the accessory is configured to be mounted in at least two positions on the head and including a first treatment surface is exposed on the treatment face when the accessory is mounted in one of the at least two positions, and including a second treatment surface that is exposed on the treatment face when the accessory is mounted in another of the at least two positions.

12 Claims, 7 Drawing Sheets

(51) Int. Cl.
*D06F 75/24* (2006.01)
*D06F 75/34* (2006.01)

(56) References Cited

U.S. PATENT DOCUMENTS

| | | | | |
|---|---|---|---|---|
| 8,555,533 | B2 * | 10/2013 | Lin | D06F 87/00 392/404 |
| 11,427,956 | B2 * | 8/2022 | Lai | D06F 75/32 |
| 2001/0030183 | A1 * | 10/2001 | Bowen | D06F 75/30 101/31 |
| 2008/0168688 | A1 * | 7/2008 | Hahn | D06F 87/00 38/77.8 |
| 2010/0269287 | A1 * | 10/2010 | Vrdoljak | A61L 2/07 15/322 |
| 2011/0219646 | A1 | 9/2011 | Vrdoljak et al. | |
| 2015/0128664 | A1 | 5/2015 | Date et al. | |
| 2016/0289889 | A1 * | 10/2016 | Lee | D06F 75/38 |
| 2017/0260685 | A1 | 9/2017 | Fung | |
| 2019/0186072 | A1 | 6/2019 | Yang et al. | |

FOREIGN PATENT DOCUMENTS

| | | | |
|---|---|---|---|
| FR | 2822480 | A1 | 9/2002 |
| GB | 2462202 | A | 2/2010 |

* cited by examiner

[Fig. 1]
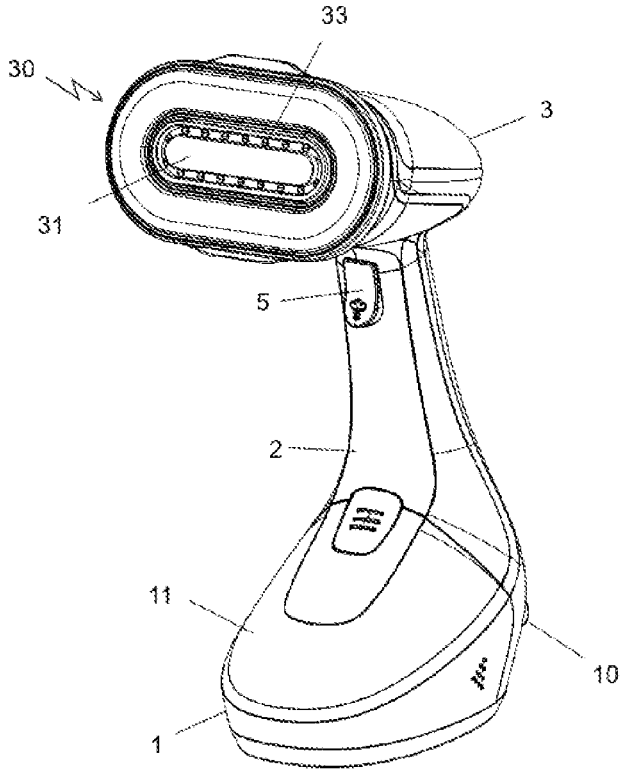

[Fig. 2]
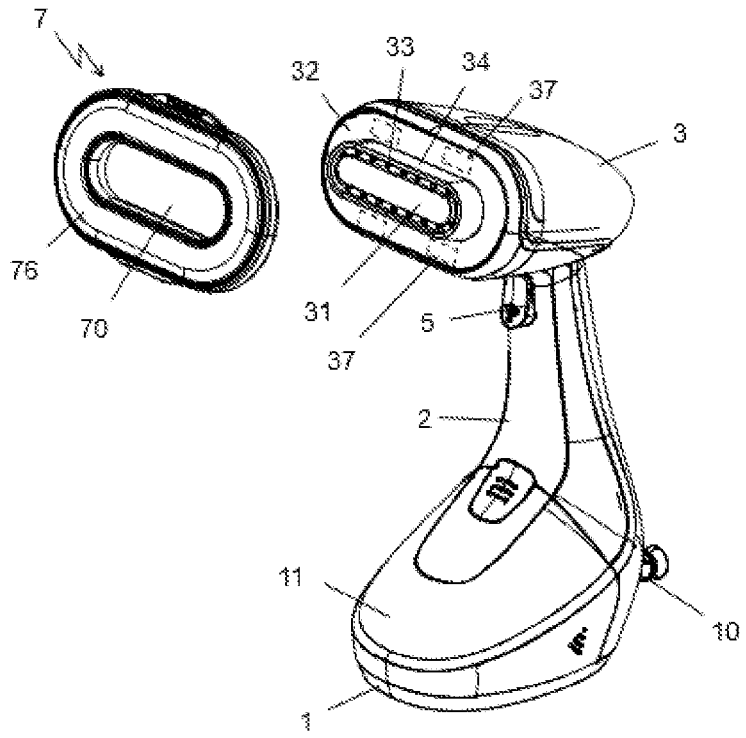

[Fig. 3]
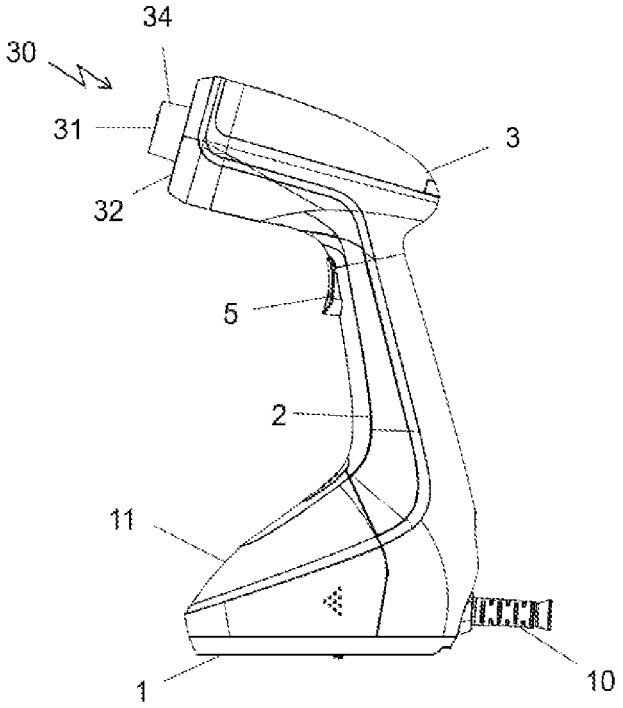

[Fig. 4]
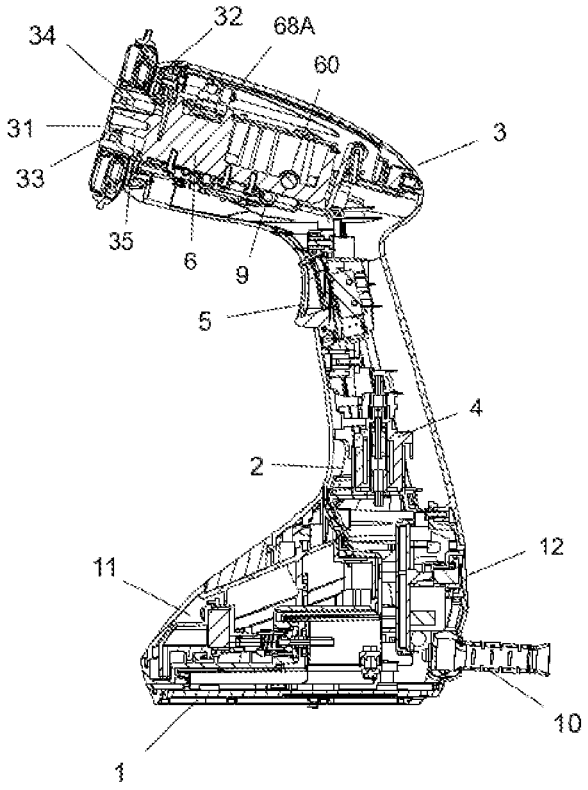

[Fig. 5]
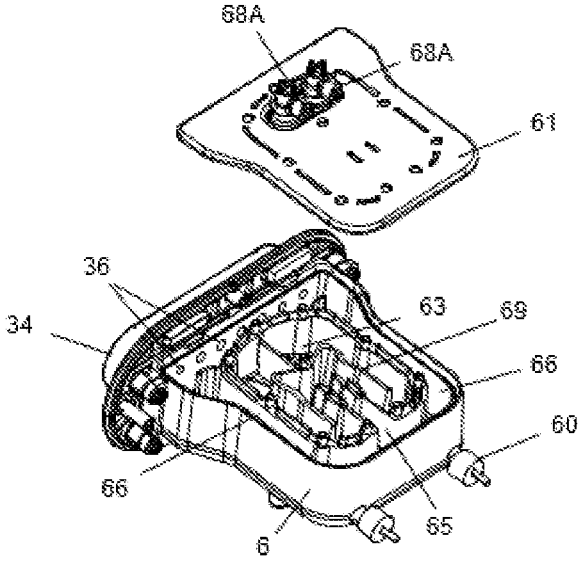

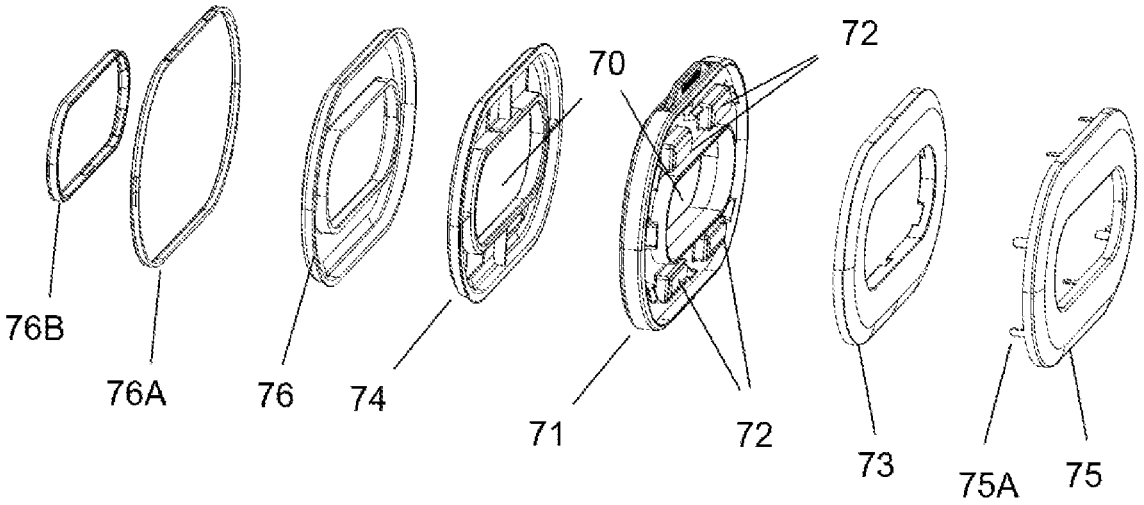
[Fig. 6]

[Fig. 7]
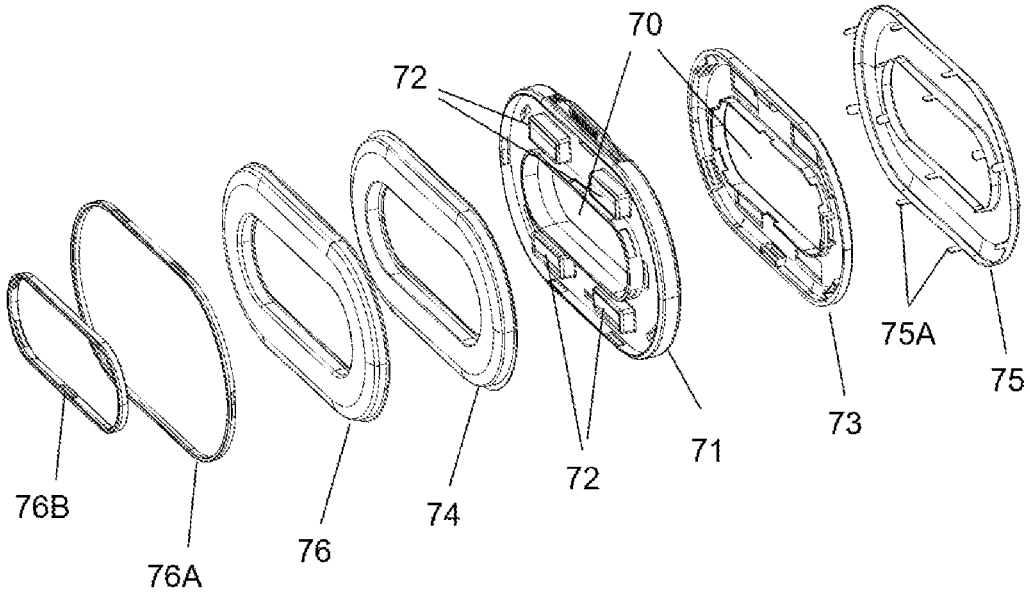

PORTABLE PRESSING APPLIANCE COMPRISING A REMOVABLE ACCESSORY

CROSS-REFERENCE TO RELATED APPLICATIONS

This application claims priority from French application number 2010647, filed Oct. 16, 2020, the disclosure of which is hereby incorporated herein by reference.

TECHNICAL FIELD

The present invention relates to the field of portable pressing appliances, comprising a handle and a steam emission head connected to the handle, wherein the steam emission head comprises a treatment face, intended to press vertically against a garment to be pressed, which is provided with at least one steam outlet orifice and one hot surface. The invention more particularly relates to a pressing appliance comprising an accessory intended to be removably mounted on the head.

STATE OF THE ART

Known from document FR2822480 is a portable pressing appliance comprising a handle and an emission head comprising a treatment face intended to press vertically against the garment to be pressed, the treatment face comprising steam outlet orifices and a hot surface intended to come into contact with the garment. The appliance also comprises a removable accessory that may be mounted on the treatment face for cleaning or removing the sheen from a garment.

However, such an accessory has the disadvantage of being relatively bulky and offers only one additional functionality for treating the garment.

SUMMARY OF THE INVENTION

The present invention seeks to remedy this disadvantage by proposing a portable pressing appliance provided with one or more removable accessories allowing the appliance to offer several functionalities for cleaning a garment, or greater longevity, while remaining small in size and economical to produce.

To that end, an object of the invention is a pressing appliance comprising a body comprising a handle and a steam emission head connected to the handle, the steam emission head comprising a treatment face intended to press vertically against a garment to be pressed, the treatment face comprising at least one steam outlet orifice and one hot surface intended to come into contact with the garment, the appliance further comprising at least one accessory intended to be removably mounted on the head and comprising a treatment surface intended to come into contact with the garment, characterized in that the accessory can be mounted in at least two positions on the head, the accessory comprising a first treatment surface that is exposed on the treatment face when the accessory is mounted in one of the two positions and comprising a second treatment surface that is exposed on the treatment face when the accessory is mounted in the other of the two positions.

When both treatment surfaces are identical, such an accessory has the advantage of offering greater longevity, especially when the treatment surface is sensitive to wear.

When the two treatment surfaces are different, this makes it possible to offer two different functionalities with the same accessory.

The appliance may also have one or more of the following features, taken alone or in combination.

According to an advantageous feature of the invention, the first treatment surface and the second treatment surface are arranged on two opposite faces of the accessory, the accessory being able to be mounted reversibly on the head.

It should be understood that reversible accessory means that it can be mounted in one direction or the other so as to allow one or the other of the treatment surfaces to appear.

According to an advantageous feature of the invention, the first treatment surface and the second treatment surface have different surface conditions and/or materials.

By way of example, the treatment surface may consist of a metal plate, a rubber surface or a textile such as velour, microfiber, etc.

According to an advantageous feature of the invention, the hot surface is arranged at the end of a projecting protrusion and the accessory comprises a through-opening that is engaged around said protrusion.

Such a feature has the advantage of offering very good ergonomics for mounting/removing the accessory on/from the head.

According to an advantageous feature of the invention, the body comprises a peripheral surface that extends at the foot of the protrusion and on which the first treatment surface or the second treatment surface is supported when the accessory is mounted on the steam emission head.

Such a feature makes it possible to have good stability of the accessory on the head and good thermal transfer by conduction between the accessory and the steam emission head.

According to an advantageous feature of the invention, the hot surface is in thermal contact with a heating body provided in the head.

Such a feature enables the heating of the hot surface by thermal conduction with the heating body.

According to an advantageous feature of the invention, the heating body encloses a vaporization chamber.

Such a feature makes it possible to use the same heating body for heating the hot surface and for producing the steam.

According to an advantageous feature of the invention, the hot surface is metallic.

According to an advantageous feature of the invention, the peripheral surface extends parallel to the hot surface.

According to an advantageous feature of the invention, the first treatment surface or the second treatment surface extends substantially in the plane of the hot surface when the accessory is mounted on the head.

Thus the treatment surface of the accessory and the hot surface are simultaneously in contact with the garment to be treated when the appliance is applied against a garment.

According to an advantageous feature of the invention, the appliance comprises an attachment device enabling the accessory to be retained on the head.

According to an advantageous feature of the invention, the attachment device comprises magnetic means ensuring the retention of the accessory on the treatment face.

Such a feature has the advantage of ensuring good retention of the accessory while offering very good ergonomics of use.

According to an advantageous feature of the invention, the body comprises at least one magnet placed behind the peripheral surface.

BRIEF DESCRIPTION OF THE FIGURES

The purposes, aspects and advantages of the present invention, according to the description given below of a particular embodiment of the invention presented by way of non-limiting example, will be better understood by referring to the attached drawings in which:

FIG. 1 is a perspective view of an appliance according to a specific embodiment of the invention equipped with its accessory;

FIG. 2 is a perspective view of the appliance shown in FIG. 1 in which the accessory is illustrated disconnected from the body of the appliance;

FIG. 3 is a side view of the appliance shown in FIG. 1 without its accessory;

FIG. 4 is a longitudinal sectional view of the appliance shown in FIG. 1;

FIG. 5 is an exploded perspective view of the heating body that forms part of the appliance shown in FIG. 1;

FIG. 6 is an exploded perspective view of the accessory that forms part of the appliance shown in FIG. 1;

FIG. 7 is another exploded perspective view of the accessory that forms part of the appliance shown in FIG. 1;

Only those elements required in order to understand the invention have been depicted. In order to facilitate interpretation of the drawings, the same elements are labeled with the same references across all the figures.

It will be noted that, in this document, the terms "horizontal," "vertical," "lower," "upper," "top," "bottom," "front," "rear," "longitudinal" and "transverse" are used to describe the appliance when it is sitting flat on its base.

FIG. 1 represents a pressing appliance comprising a body having a portable case made of plastic, which comprises a base 1 mounted on a handle 2 and a steam emission head 3, whereby the base 1 comprises a flat lower face upon which the pressing appliance may be set stably in a substantially vertical position.

The base 1 of the pressing appliance comprises a power supply cord 10, which makes it possible to connect it to a household electricity network, and the steam emission head 3 comprises a rear side equipped with a button 12 (which can be seen in FIG. 4), enabling the appliance to be turned on and off.

The base 1 encloses an electric pump 4, which can be seen in FIG. 4, the operation whereof is controlled by means of a trigger 5 arranged at the top of the handle 2, the trigger 5 actuating, in a manner known per se, a switch connected to a circuit board for control of the pump 4, not shown in the figures. The pump 4 is fed with liquid from a reservoir 11 formed in the base 1, said reservoir 11 being advantageously removable from the pressing appliance in order to facilitate the filling thereof.

The steam emission head 3 is slim and extends transverse to the longitudinal direction of the handle 2, and comprises a longitudinal end equipped with a treatment face 30 intended to be used vertically in relation to a garment to be pressed.

According to FIGS. 1 to 3, the treatment face 30 comprises a protrusion 34 which projects from the body and which comprises one end supporting a hot surface 31, preferably of metal and oblong in shape.

The protrusion 34 also comprises a series of steam outlet orifices 33 arranged in the bottom of the groove made in the vicinity of the periphery of the protrusion 34. The protrusion 34 advantageously occupies a central position on the treatment face 30 and has a slightly frustoconical shape. The treatment face 30 has, at the foot of the protrusion 34, a peripheral surface 32 that extends parallel to the hot surface 31 and forms a shoulder extending to the edge of the body of the head 3.

Preferably, the peripheral surface 32 is produced from a metal piece which is connected to the end of the head 3 and which is in thermal contact with a heating body 6, visible in FIGS. 4 and 5, provided inside the head 3.

The heating body 6 has the general shape of a rectangular parallelepiped and comprises, in a manner known per se, a casting, for example of aluminum, and a heating resistive element 60, such as an electric resistance, bent in a U-shape and incorporated into the casting.

The heating body 6 comprises a front face in thermal contact with the hot surface 31, the front end of the heating body 6 extending into the protrusion 34. In this way, the hot surface 31 is heated by thermal conduction through the protrusion 34.

The heating body 6 also comprises a cover 61 which rests sealably on the casting, and an instantaneous vaporization chamber 63 delimited by the casting and the cover 61. The casting more particularly comprises a peripheral wall on which the cover 61 rests and which laterally delimits the instantaneous vaporization chamber 63.

Advantageously, the power supply of the heating resistive element 60 is regulated by means of a thermostat 9 (which can be seen in FIG. 4) around a setpoint temperature, measured at the center of the instantaneous vaporization chamber 63, for example between 110° C. and 150° C.

The cover 61 comprises two water injection orifices 68A opening into the instantaneous vaporization chamber 63 in the vicinity of the front end of said chamber, both water injection orifices 68A being connected to the pump 4 by means of a fluid-conveying conduit (not shown in the figures).

The instantaneous vaporization chamber 63 comprises a bottom wall forming a vaporization surface on which the liquid injected via the two water injection orifices 68A is vaporized and comprises a passage 65 for the steam outlet provided on the peripheral wall, opposite the treatment face 30.

The pressing appliance further comprises several baffle walls 69 extending into the instantaneous vaporization chamber 63 between the area where water is injected onto the bottom wall and the passage 65 for the steam outlet. These baffle walls 69 form baffle plates configured to deflect the flow of steam generated in the instantaneous vaporization chamber 63 and to retain any water droplets that may be transported by the flow of steam.

The heating body 6 also comprises a steam distribution circuit 66 in which the flow of steam from the instantaneous vaporization chamber 63 is intended to flow. According to the embodiment represented in the figures, the steam distribution circuit 66 is arranged around the instantaneous vaporization chamber 63.

The steam distribution circuit 66 is fluidly connected on the one hand to the instantaneous vaporization chamber 63 via the passage 65 for the outlet of the steam, and on the other hand to the steam outlet orifices 33 via conduits 36 provided in the front face of the heating body 6. The steam distribution circuit 66 is thus configured to supply the steam outlet orifices 33 with steam. In particular, the steam leaving the instantaneous vaporization chamber 63 through the passage 65 can flow in the steam distribution circuit 66, on both sides of the instantaneous vaporization chamber 63, in order to then be diffused through conduits which open into a distribution chamber 35 provided upstream from the steam outlet orifices 33, as can be seen in FIG. 4.

More particularly according to the invention and to FIGS. 1 and 2, the appliance comprises one or several accessories 7 intended to be mounted removably against the peripheral surface 32 of the head 3, each accessory 7 having a through-opening 70 adapted to allow the passage of the protrusion 34 when the accessory 7 rests against the peripheral surface 32.

The accessory 7 advantageously is oblong in shape, the outer contour of which conforms to the shape of the outer contour of the body of the head 3, the through-opening 70 being arranged in a central position and having a shape conforming to the shape of the outer contour of the protrusion 34 in such a way that the insertion of the protrusion 34 into the through-opening 70 ensures the centering of the accessory 7 on the head 3.

According to FIGS. 6 and 7, the accessory 7 comprises a central body 71 made of plastic comprising four metal inserts 72, distributed on both sides of the through-opening 70, and comprises a first end plate 73 and a second end plate 74 which snap onto two opposite faces of the central body 71 of the accessory 7, concealing the metal inserts 72.

Preferably, the first end plate 73 is covered by a first covering which defines a first treatment surface 75 and the second end plate 74 is covered by a second covering, preferably different from the first covering, which defines a second treatment surface 76.

In the example illustrated in the figures, the first treatment surface 75 is a metal plate affixed to the outer face of the first end plate 73. The metal plate is advantageously attached by tabs 75A that are bent behind the first end plate 73. The second treatment surface 76 is a textile, such as a velour or microfiber, which is affixed onto the outer face of the second end plate 74. The textile is attached by means of two retaining rings 76A, 76B which are respectively made at the peripheral edge and through-opening 70 of the second end plate 74.

Preferably, as can clearly be seen in FIG. 3, the thickness of the accessory 7 corresponding substantially to the height of the protrusion 34 in such a way that one of the treatment surfaces 75, 76 is in the extension of the hot surface 31 when the other treatment surface 76, 75 of the accessory 7 rests against the peripheral surface 32 of the head 3.

In order to ensure a magnetic retention of the accessory or accessories 7 on the head 3, the head 3 comprises four magnets 37 arranged behind the peripheral surface 32, illustrated in dotted lines in FIG. 2, the magnets 37 being arranged so as to come against metal inserts 72 carried by the accessory 7 when said accessory is installed onto the head 3.

The appliance constructed in this way has the advantage of having an accessory 7 that is very ergonomic for installing onto and removing from the head 3 of the appliance.

In fact, the user can install the accessory 7 onto the head 3 simply by aligning the protrusion 34 with the through-opening 70 of the accessory 7, and by engaging the accessory 7 onto the head 3 in such a way as to apply one of the treatment surfaces 75, 76 against the peripheral surface 32.

When the accessory 7 is placed in this position, the magnets 37 of the head 3 exert a magnetic attraction on the metal inserts 72 in such a way that the accessory 7 is held in position on the head 3.

The user can then use the appliance by actuating the trigger 5 of the appliance, to cause the pump 4 to start up, sending water into the vaporization chamber 63, causing the outlet of steam through the steam outlet orifices 33.

During this use, the accessory 7 then has a treatment surface 75, 76 that is arranged all around the hot surface 31 and the steam outlet orifices 33 so that the treatment surface 75, 76 achieves the same efficacy of treatment irrespective of the direction of movement of the head 3 parallel to the garment.

Moreover, the user has the ability to choose, between the two treatment surfaces 75, 76 of the accessory, the one to use for treating the garment. Thus, he can choose to place the accessory 7 on the head 3 in such a way that it is either the first treatment surface 75 or the second treatment surface 76 that is exposed around the hot surface 31.

Thus, if he arranges the accessory 7 so that the first treatment surface 75 is applied against the peripheral surface 32, then the second treatment surface 76 will be the active surface in contact with the garment. Conversely, when the user arranges the accessory 7 so that the second treatment surface 76 is applied against the peripheral surface 32, then the first treatment surface 75 will be the active surface in contact with the garment.

Thus, with a limited number of accessories 7, such an appliance has the advantage of offering a greater diversity of treatment surfaces.

In particular, when the user places the accessory 7 so that the first treatment surface 75, consisting of the metal plate, is oriented toward the garment to be treated, the appliance benefits from the entire surface of the metal plate of the accessory 7, in addition to the hot surface 31, to heat the garment, the metal surface of the accessory 7 then being heated by radiation and thermal conduction with the protrusion 34 and the peripheral surface 32.

Conversely, when the user places the accessory 7 so that the second treatment surface 76, consisting of a textile surface, is oriented toward the garment to be treated, the appliance may be used while benefiting from the properties of this surface to act on the garment.

If this surface consists of velour, it will exert a pulling on the garment during the lateral movement of the pressing head along the garment, which will contribute to improving the pressing performance.

If this surface consists of microfiber, said microfiber will have the advantage of being more effective at lifting off dust and dirt that may be clinging to the garment.

In this way, an appliance is obtained that makes it possible to carry out different types of work in an optimized way, while being reduced in size and cost due to the small number of accessories accompanying the appliance.

Of course, the invention is in no way limited to the embodiment described and illustrated, since this embodiment was only provided by way of example. Changes can still be made, particularly with regard to the constitution of the various elements or by substituting technical equivalents, without departing from the scope of protection of the invention.

Thus, the appliance may also comprise several accessories with different treatment surfaces. For example, the appliance may comprise a first accessory with a first treatment surface consisting of velour and a second treatment surface consisting of microfiber. The accessory may also comprise a second accessory for which both treatment faces are identical and consist for example of a metal plate.

In an alternative embodiment not shown, the accessory may also be attached to the head by an attachment means other than magnetic means, for example by snap-on.

In an alternative embodiment not shown, the hot surface may also have its own resistive element, independent of the heating resistance of the heating body enclosing the vaporization chamber.

The invention claimed is:

1. A pressing appliance comprising:

a body comprising a handle and a steam emission head connected to the handle, the steam emission head comprising a treatment face configured to press against a garment to be pressed, the treatment face comprising at least one steam outlet orifice and heatable surface configured to come into contact with the garment, at least one accessory configured to be removably mounted on the steam emission head-, wherein the at least one accessory is configured to be mounted in at least two orientations relative to the steam emission head and comprises a first treatment surface exposed on the treatment face when the accessory is mounted in one of the at least two orientations, and comprises a second treatment surface exposed on the treatment face when the accessory is mounted in another of the at least two orientations, wherein the first treatment surface and the second treatment surface have different surface textures and/or materials.

2. The pressing appliance according to claim 1, wherein the first treatment surface and the second treatment surface are arranged on two opposite faces of the at least one accessory, the at least one accessory configured to be mounted reversibly on the steam emission head.

3. The pressing appliance according to claim 1, wherein the heatable surface is arranged at an end of a projecting protrusion and wherein the at least one accessory comprises a through-opening configured to engage around the protrusion.

4. The pressing appliance according to claim 3, wherein the body further comprises a peripheral surface extending at a foot of the projecting protrusion and on which the first treatment surface or the second treatment surface is supported when the at least one accessory is mounted on the steam emission head.

5. The pressing appliance according to claim 4, wherein the peripheral surface extends parallel to the heatable surface.

6. The pressing appliance according to claim 1, wherein the heatable surface is in thermal contact with a heating body provided in the steam emission head.

7. The pressing appliance according to claim 6, wherein the heating body encloses a vaporization chamber.

8. The pressing appliance according to claim 1, wherein the heatable surface is metallic.

9. The pressing appliance according to claim 1, wherein the first treatment surface or the second treatment surface extends substantially in a plane defined by the heatable surface when the at least one accessory is mounted on the steam emission head.

10. The pressing appliance according to claim 1, further comprising an attachment device enabling the at least one accessory (7) to be retained on the steam emission head (3).

11. The pressing appliance according to claim 10, wherein the attachment device comprises at least one magnet for retaining the at least one accessory on the treatment face.

12. The pressing appliance according to claim 11, wherein the body comprises at least one magnet arranged behind a peripheral surface thereof.

* * * * *